US007021496B2

(12) United States Patent
Almond

(10) Patent No.: US 7,021,496 B2
(45) Date of Patent: Apr. 4, 2006

(54) LIQUID DISPENSING APPARATUS

(76) Inventor: Kelly George Almond, 9125-180A Avenue N.W., Edmonton, Alberta, T5Z 2K5 (CA)

( * ) Notice: Subject to any disclaimer, the term of this patent is extended or adjusted under 35 U.S.C. 154(b) by 0 days.

(21) Appl. No.: 10/691,877

(22) Filed: Oct. 23, 2003

(65) Prior Publication Data

US 2004/0099689 A1 May 27, 2004

(51) Int. Cl.
*B65D 35/56* (2006.01)

(52) U.S. Cl. ..... 222/105; 222/146.6; 222/185.1

(58) Field of Classification Search ..... 222/105, 222/146.6, 185.1
See application file for complete search history.

(56) References Cited

U.S. PATENT DOCUMENTS 2,781,153 A * 2/1957 Roberts ..... 222/183
4,757,920 A * 7/1988 Harootian et al. ..... 222/146.6
5,249,706 A * 10/1993 Szabo ..... 222/20
5,634,343 A * 6/1997 Baker, III ..... 62/3.64
6,039,219 A * 3/2000 Bach et al. ..... 222/160
6,186,361 B1 * 2/2001 Teetsel, III ..... 222/1
6,561,386 B1 * 5/2003 Martens ..... 222/105
6,755,324 B1 * 6/2004 Geshay ..... 222/1
2003/0098314 A1 * 5/2003 Phelps et al. ..... 222/1

OTHER PUBLICATIONS

Althouse, Andrew D., Turnquist, Carl H., Bracciano, Alfred F., *Modern Refrigeration and Air Conditioning*; Goodheart-Willcox Co., 1988, pp. 88-90, 118-119, 306-307, 383.

* cited by examiner

*Primary Examiner*—Joseph A. Kaufman
(74) *Attorney, Agent, or Firm*—Davis & Bujold, P.L.L.C.

(57) ABSTRACT

A liquid dispensing apparatus includes a housing having an exterior and an insulated interior cavity. The cavity is accessible through an access opening. A closure is provided for selectively closing the access opening to the cavity. A refrigeration assembly is provided for cooling the cavity. A flow channel is provided having a first end and a second end. The first end is positioned on a bottom of the cavity. The second end is positioned on the exterior of the housing. Liquids flow by force of gravity from the cavity to the exterior of the housing. A coupling is positioned at the first end of the flow channel. The coupling is adapted to couple the flow channel with a liquid container positioned within the cavity. A valve is positioned at the second end of the flow channel to control the flow of liquid flowing through the flow channel.

2 Claims, 4 Drawing Sheets

LIQUID DISPENSING APPARATUS

FIELD OF THE INVENTION

The present invention relates to a liquid dispensing apparatus.

BACKGROUND OF THE INVENTION

Most liquid dispensing apparatus are dedicated to dispensing liquid and can serve no other function.

SUMMARY OF THE INVENTION

What is required is a liquid dispensing apparatus which is capable of performing other functions when not required for dispensing liquid.

According to the present invention there is provided a liquid dispensing apparatus which includes a housing having an exterior and an insulated interior cavity. The cavity is accessible through an access opening. A closure is provided for selectively closing the access opening to the cavity. Means are provided for cooling the cavity. A flow channel is provided having a first end and a second end. The first end is positioned on a bottom of the cavity. The second end is positioned on the exterior of the housing. Liquids flow by force of gravity from the cavity to the exterior of the housing. A coupling is positioned at the first end of the flow channel. The coupling is adapted to couple the flow channel with a liquid container positioned within the cavity. A valve is positioned at the second end of the flow channel to control the flow of liquid flowing through the flow channel.

The liquid dispensing apparatus, as described above, is capable of functioning as a cooler when not used as a liquid dispensing apparatus. It is preferred that the means for cooling the cavity is a refrigeration assembly, so that the liquid dispensing apparatus functions as a small refrigerator or freezer.

It is preferred that a male coupling be positioned in the cavity. The male coupling is adapted to mate with a female coupling on a liquid container.

A liquid container considered to be particularly suited for use with the above described liquid dispensing apparatus is a cardboard box having a collapsible bag liner. This form of liquid container is well suited for gravity feed dispensing, as described above.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
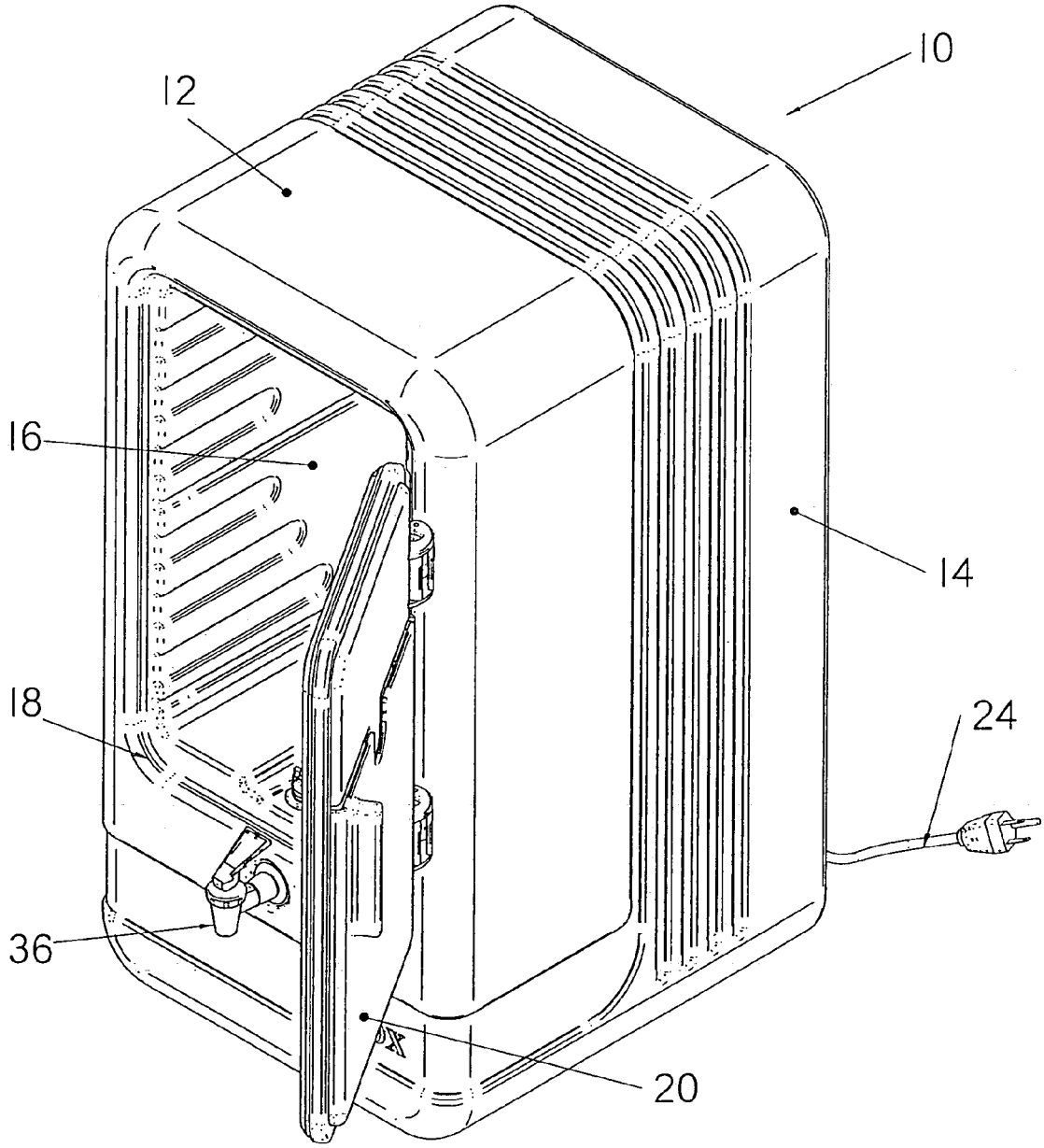
FIG. 1 is a perspective view of a liquid dispensing apparatus constructed in accordance with the teachings of the present invention.

The preferred embodiment, a liquid dispensing apparatus generally identified by reference numeral 10, will now be described with reference to FIGS. 1 through 4.

Figure 4:
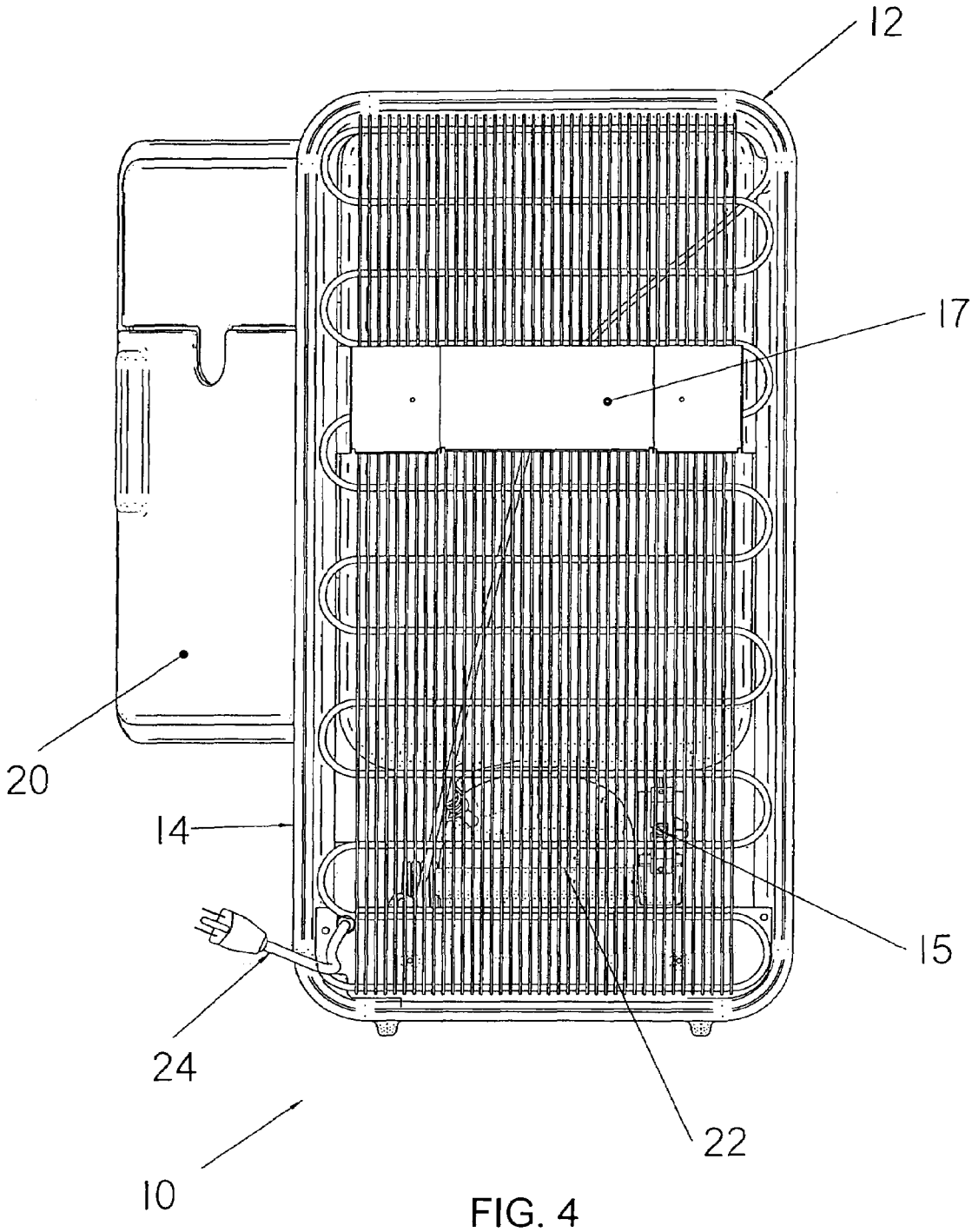
FIG. 4 is rear elevation view of the liquid dispensing apparatus illustrated in FIG. 1.

Structure and Relationship of Parts:

Referring to FIG. 1, liquid dispensing apparatus 10 includes a housing 12 that has an exterior 14 and an insulated interior cavity 16. Cavity 16 is accessed through an access opening 18. A pivotally mounted closure door 20 is provided for selectively closing access opening 18 to cavity 16. Although closure door 20 has been shown as pivoting, it will be appreciated that a sliding door could also be made to function in this application. Referring to FIG. 4, a refrigeration assembly 22 is provided that is adapted to cool cavity 16 illustrated in FIG. 1. A power supply cord 24 is provided for supplying power to refrigeration assembly 22.

Figure 3:
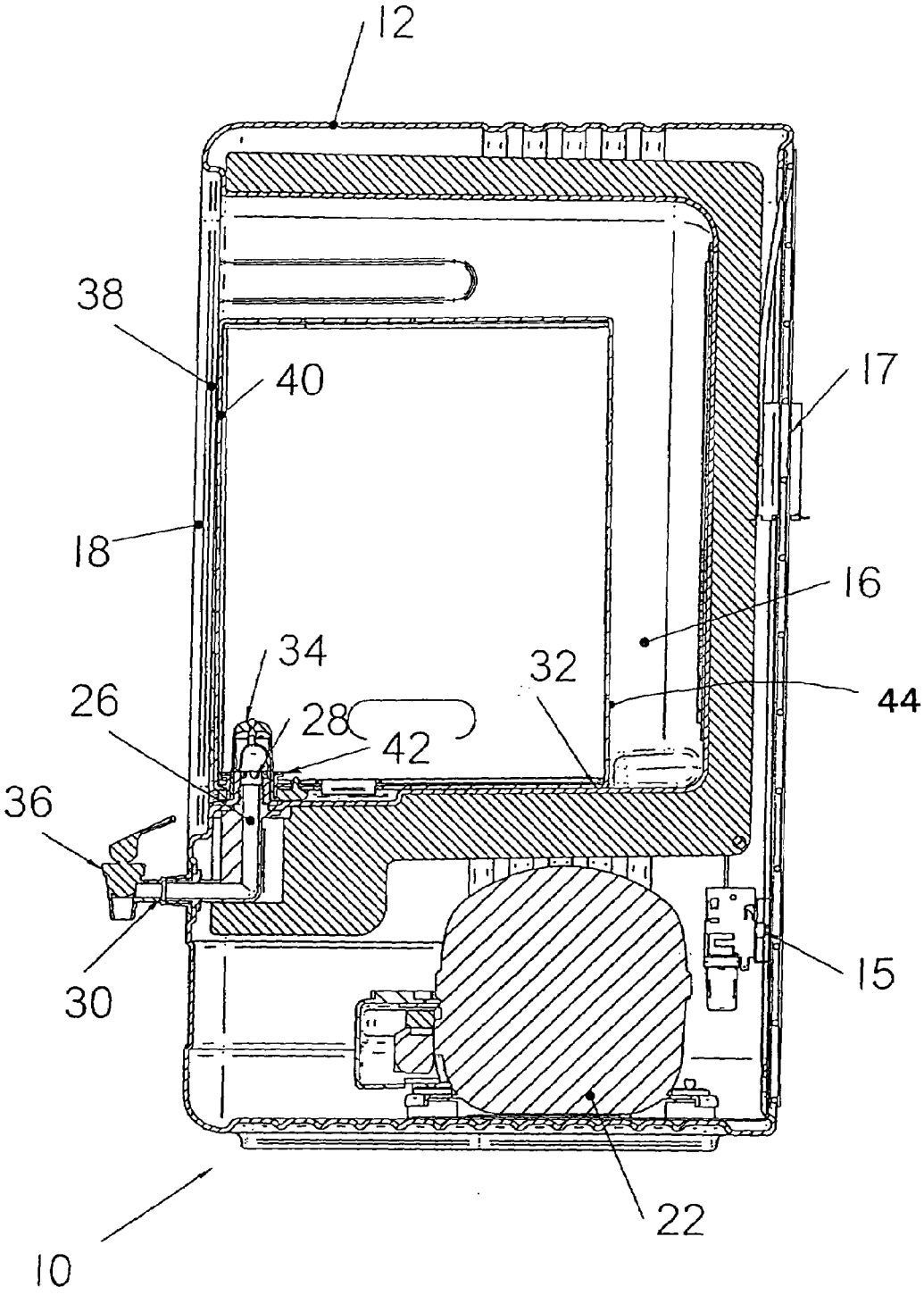
FIG. 3 is a side elevation view, in section, of the liquid dispensing apparatus illustrated in FIG. 2, with a male to female coupling between the liquid container and a flow passage of the liquid dispensing apparatus.

Referring to FIG. 3, a flow channel 26 is provided that has a first end 28 and a second end 30. First end 28 of flow channel 26 is positioned on a bottom 32 of cavity 16 and second end 30 of flow channel 26 is positioned on exterior 14 of housing 12, such that liquids flow by force of gravity from cavity 16 to exterior 14 of housing 12. A male coupling 34 is positioned at first end 28 of flow channel 26. A valve 36 is positioned at second end 30 of flow channel 26 to control the flow of liquid flowing through flow channel 26.

Figure 2:
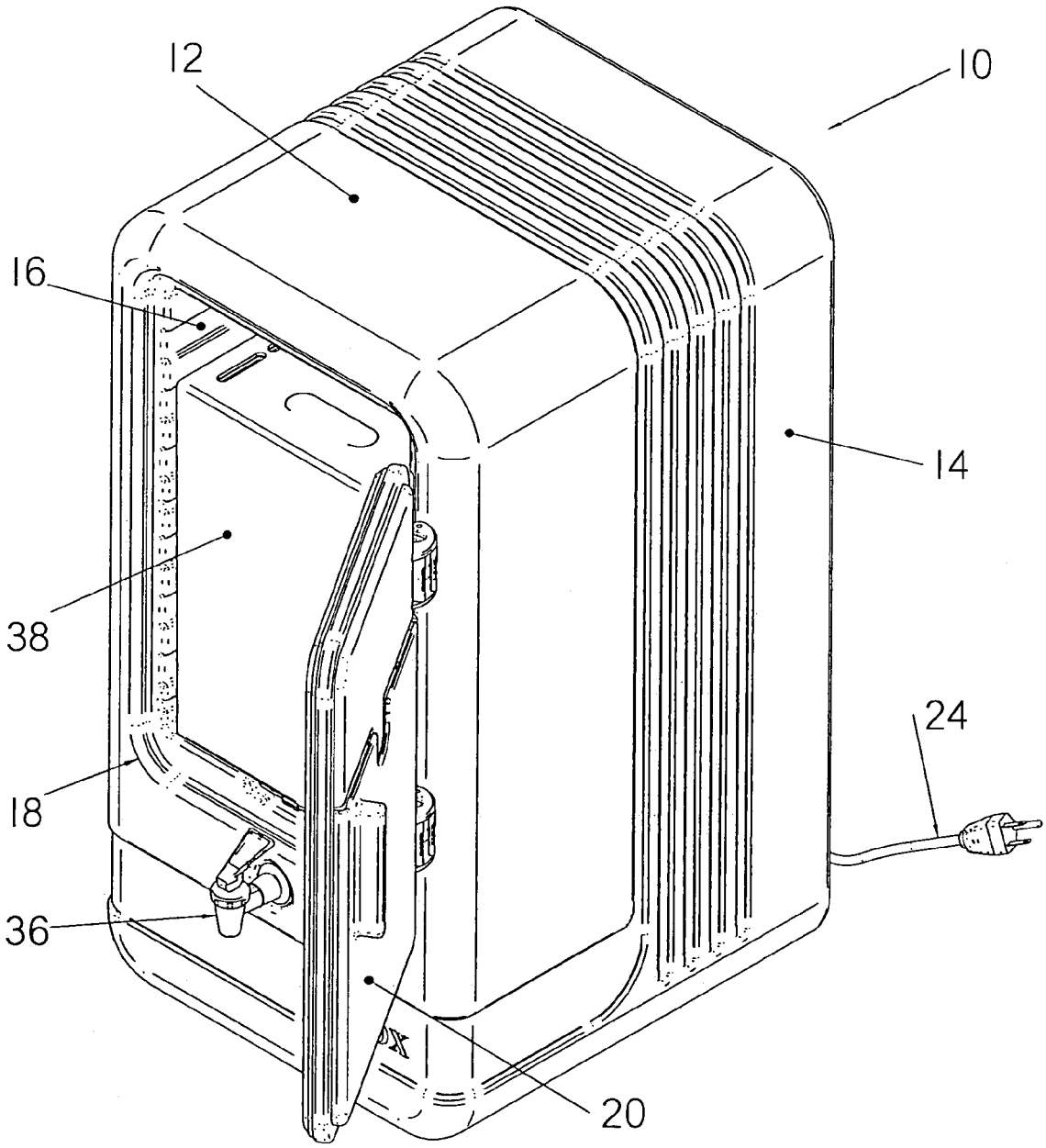
FIG. 2 is a perspective view of the liquid dispensing apparatus illustrated in FIG. 1, with a liquid container, in the form of a cardboard box having a flexible bag liner containing liquid, positioned with the cavity of the liquid dispensing apparatus.

Referring to FIG. 2, a cardboard box 38 is positioned within cavity 16 of housing 12. Referring to FIG. 3, cardboard box 38 has a collapsible bag liner 40 containing liquid. Collapsible bag liner 40 has a female coupling 42 which is mounted on an exterior surface 44 of cardboard box 38. Cardboard box 38 is positioned within cavity 16 of housing 12 such that male coupling 34 at first end 28 of flow channel 26 engages female coupling 42 on exterior surface 44 of cardboard box 38, whereby liquid flows by force of gravity from collapsible bag liner 40 through female coupling 42 and male coupling 34, along flow channel 26 to valve 36. Referring to FIG. 4, a rear mounting bracket 17 is provided to facilitate mounting liquid dispensing apparatus 10 onto a wall or other vertical surface. This feature enables liquid dispensing apparatus to be placed in a convenient location without occupying counter space. Referring to FIG. 4, a rear thermostat 15 is provided, the purpose of which will hereinafter be further described.

While the illustrated embodiment shows the use of cardboard box 38 with collapsible bag liner 40 filled with liquid, it will be appreciated that other types of liquid containers could also be used in combination with liquid dispensing apparatus 10. If other types of liquid containers are to be used, male coupling 34 may be changed to suit the different style of liquid container.

Operation:

The use and operation of liquid dispensing apparatus generally identified by reference numeral 10, will now be described with reference to FIGS. 1 through 4. Referring to FIG. 1, to use liquid dispensing apparatus 10, as described above, door liquid container such as cardboard box 38 with a collapsible bag liner 40 containing liquid as described above, is placed within cavity 16 of housing 12. Cardboard box 38 is passed through access opening in housing 12, and then positioned within cavity 16 so male coupling 34 at first end 28 of flow channel 26 engages female coupling 42 on exterior surface 44 of cardboard box 38. Pivotally mounted closure door 20 pivoted to closing access opening 18 to cavity 16. If liquids contained within collapsible bag liner are required to be cooled, then power supply cord 22 is connected to a source of power to supply refrigeration assembly with power to cool cavity 16. When liquids are to be dispensed, valve 36 can be activated so that liquid flows by force of gravity from collapsible bag liner 40 through female coupling 42 and male coupling 34, along flow channel 26 to exit through valve 36. Flow of liquids is stopped when valve 36 is shut off.

In the event that dispensing apparatus is not required to dispense liquids, it is also capable of functioning as a cooler for other items. It is preferred that the means for cooling the cavity is a refrigeration assembly, so that the liquid dispensing apparatus 10 functions as a small refrigerator. Referring to FIG. 4, rear thermostat 15 has both a refrigerator and a freezer setting. By moving rear thermostat 15 into the cooler temperature ranges, the operation of liquid liquid dispensing apparatus 10 can be converted to that of a small refrigerator to that of a small freezer.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly. requires that there be one and only one of the elements.

It will be apparent to one skilled in the art that modifications may be made to the illustrated embodiment without departing from the spirit and scope of the invention as hereinafter defined in the Claims.

The embodiment of the invention in which an exclusive property or privilege is claimed are defined as follows:

1. A liquid dispensing apparatus, comprising in combination:

a cardboard box having a collapsible bag liner containing liquid, the collapsible bag liner having a frangible female coupling which is mounted on an exterior surface of the cardboard box;

a refrigerator with a housing having an exterior and an insulated interior cavity, the cavity being accessible through an access opening;

a closure door for selectively closing the access opening to the cavity;

a refrigeration assembly adapted to cool the cavity;

a flow channel having a first end and a second end, the first end being positioned on a bottom of the cavity and the second end being positioned on the exterior of the housing, such that liquids flow by force of gravity from the cavity to the exterior of the housing;

a male coupling positioned at the first end of the flow channel, the coupling being adapted to couple the flow channel with the female coupling on the cardboard box positioned within the cavity; and a valve being positioned at the second end of the flow channel to control the flow of liquid flowing through the flow channel.

2. The liquid dispensing apparatus of claim 1, wherein the male coupling positioned at the first end of the flow channel is coupled with the housing, the female coupling of the cardboard box matingly receives the male coupling of the housing.

* * * * *